US007665633B2

(12) United States Patent
MacMichael et al.

(10) Patent No.: US 7,665,633 B2
(45) Date of Patent: Feb. 23, 2010

(54) APPARATUS AND METHOD OF DISPENSING SMALL QUANTITIES OF PARTICLES

(75) Inventors: Donald Bruce Atherton MacMichael, Ickleford (GB); Ian Joseph Smith, Harston (GB)

(73) Assignee: Meridica Limited (GB)

( * ) Notice: Subject to any disclaimer, the term of this patent is extended or adjusted under 35 U.S.C. 154(b) by 768 days.

(21) Appl. No.: 10/503,370

(22) PCT Filed: Jan. 22, 2003

(86) PCT No.: PCT/GB03/00200

§ 371 (c)(1),
(2), (4) Date: Oct. 25, 2004

(87) PCT Pub. No.: WO03/066436

PCT Pub. Date: Aug. 14, 2003

(65) Prior Publication Data

US 2005/0040185 A1 Feb. 24, 2005

(30) Foreign Application Priority Data

Feb. 4, 2002 (GB) ..... 0202538.5

(51) Int. Cl.
*B67D 5/64* (2006.01)

(52) U.S. Cl. ..... 222/161; 222/1; 222/181.1; 222/189.11; 222/196; 222/198; 366/117

(58) Field of Classification Search ..... 222/1, 222/197–200, 160, 52, 63, 161, 181.1, 181.2, 222/185.1, 189.06, 189.07, 189.11, 196; 366/117–118, 111–112

See application file for complete search history.

(56) References Cited

U.S. PATENT DOCUMENTS

| | | | | |
|---|---|---|---|---|
| 1,712,235 | A | | 5/1929 | Small |
| 2,246,497 | A | | 6/1941 | Beck |
| 2,573,315 | A | | 10/1951 | Dericks |
| 2,676,733 | A | | 4/1954 | Lober |
| 2,742,184 | A | | 4/1956 | Yerkes et al. |
| 3,179,302 | A | * | 4/1965 | Murray ..... 222/233 |
| 3,353,572 | A | | 11/1967 | Anderson et al. |
| 3,791,558 | A | | 2/1974 | Katusha |

(Continued)

FOREIGN PATENT DOCUMENTS

AU 5330609 B 12/1983

(Continued)

*Primary Examiner*—Frederick C. Nicolas
(74) *Attorney, Agent, or Firm*—Hamilton, Brook, Smith and Reynolds, P.C.

(57) ABSTRACT

An apparatus for dispensing small quantities of particles, the apparatus comprises a hopper (20) provided with a sieve (21) at a bottom portion thereof, the hoper defining a powder-containing zone (42) above the sieve which in use contains powder to be dispensed therefrom trough the sieve (21), a support for the hopper, the support holding a portion of the hopper so that the hopper can in use be held above a container into which the dispensed powder is to be received, at least one actuator for delivering impact energy to the hopper for causing powder to be dispensed through the sieve when the hopper receives the impact energy, and a deagglomeration device (58) disposed in the powder-containing zone (42).

16 Claims, 3 Drawing Sheets

U.S. PATENT DOCUMENTS

| | | | | |
|---|---|---|---|---|
| 4,083,475 | A * | 4/1978 | Venner et al. | 222/198 |
| 4,188,907 | A * | 2/1980 | Lipani | 399/261 |
| 4,378,078 | A | 3/1983 | Daniels | |
| 4,684,041 | A | 8/1987 | Jones et al. | |
| 5,215,228 | A | 6/1993 | Andrews et al. | |
| 5,685,348 | A | 11/1997 | Wegman et al. | |
| 6,471,096 | B1 * | 10/2002 | Dave | 222/200 |
| 2004/0045979 | A1 | 3/2004 | MacMichael | |

FOREIGN PATENT DOCUMENTS

| | | | |
|---|---|---|---|
| EP | O 225 836 | A1 | 6/1987 |
| FR | 1 281 992 | A | 1/1962 |
| GB | 986 559 | A | 3/1965 |
| GB | 2 185 242 | A | 7/1987 |
| GB | 2306950 | A | 5/1997 |
| WO | WO 01/33176 | A1 | 5/2001 |
| WO | WO 03/026965 | A1 | 4/2003 |

* cited by examiner

APPARATUS AND METHOD OF DISPENSING SMALL QUANTITIES OF PARTICLES

RELATED APPLICATIONS

This application is the U.S. National Stage of International Application No. PCT/GB03/00200, filed Jan. 22, 2003, published in English, and claims priority under 35 U.S.C. § 119 or 365 to Great Britain Application No. 0202538.5, filed Feb. 4, 2002.

The present invention relates to an apparatus and method for dispensing small quantities of particles, and to a deagglomeration device for such an apparatus.

The flow characteristics of powders have a tendency to prevent flow of the powder through small holes, for example in a sieve located at the bottom of a hopper containing the powder, under the action of gravity because the powder particles tend to agglomerate into larger particles. However it is well known that shaking the hopper causes the powder to flow. It has been shown that applying discrete movements of a well-defined nature to the hopper can cause a reproducible amount of powder to flow through the holes.

For example, WO-A-01/33176 discloses an apparatus and method for dispensing small quantities of particles, in particular small amounts of medicament especially in a powder form. The apparatus uses dispense head comprising a funnel shaped hopper with a plurality of holes in a membrane at the base of the hopper, forming a sieve-like element, through which powder present in the hopper may fall. A preferred method is to tap the hopper horizontally to cause such a movement, thereby controllably dispensing powder through the membrane. The tapping is achieved by an electromechanical actuator which delivers impact energy to the hopper, which in turn causes a small number of particles to fall through the sieve-like element and onto a weighing measuring balance. The actuator is a horizontally oriented solenoid which taps the side of the hopper via a rod which supports the hopper at one end and has the solenoid mounted at the other end. A tapping action can also be done with a vertical component to the action of the actuator or the resultant movement of the hopper.

FIG. 1 shows schematically the dispensing head of a precision powder metering system as described in WO-A-01/33176.

Referring to FIG. 1, the device consists of a powder dispense head comprising a hopper 1 for a powder material, for example a medicament used for administration to the lungs of a patient via a powder inhaler. The hopper 1 is of generally frusto-conical form with the larger end 2 open and uppermost. The smaller end 3 is closed by a plate 4 in which a plurality of holes 5 are formed, thereby forming a sieve. When a powder 7 is placed in the hopper 1, some powder 7 may initially fall through the holes 5 but thereafter, in general, the powder flow stops as the powder 7 jams in the holes 5. The flow of powder 7 through the holes 5 can be made controllable and reproducible by the choice of appropriate dimensions for the holes to match the properties of the powder. Typically, the holes lie in the range of from 10 microns to 1000 microns.

In order to use the apparatus for precision dispensing, a receptacle 8 for the powder 7 is placed under the plate 4 and the hopper 1 is tapped on the sidewall 9 thereof at a location 6. The tap may be in a form that results from the impact of a mass travelling at a controlled velocity. The resulting motion of the hopper 1 and powder 7 causes the powder 7 to flow through the holes 5 in the plate 4 for a small period of time following the impact, after which the powder flow stops. Thus a discrete amount of powder 7 is controllably dispensed into the receptacle 8 as a result of each tap.

In order to accurately dispense a desired total amount of the powder 7, a plurality of taps are used to fill each receptacle 8 and the total weight of powder 7 dispensed into the receptacle 8 is measured in real time so that as soon as the required amount has been dispensed, the tapping can be stopped. The rate of tapping is controlled by a control computer. If desired, a mechanical action on the dispense head other than tapping may be employed controllably to dispense the powder.

The known dispense head described hereinabove relies for its effectiveness on its ability to dispense roughly consistent amounts of powder with each successive mechanical action or tap. This occurs because a roughly similar amount of drug powder is released through the holes on each occasion, as the bridge of powder over any given hole is broken. In a typical application the powder may consist of particles which are 20 to 100 microns diameter, and the holes may be 300 or 400 microns diameter.

This known system works very well with the majority of materials. However it has some shortcomings when loaded with materials which have a tendency to agglomerate. Sometimes drug materials can be ground or milled down to very small particle size, to help with drug dissolution and absorption within the patient, or for other purposes. When the small particles are of the order of a few microns in diameter, the powder is typically described in the art as being 'micronised'. These materials frequently have a tendency to form large loose agglomerates when handled. These agglomerates take the form of larger assemblies of particles formed from loosely grouped individual particles, rather like snowballs made from powdered snow. These larger particles may be many different sizes—commonly ranging from tens of microns in diameter up to 2 or 3 millimeters in diameter, or even larger.

It will be appreciated that with a powder which has a tendency to agglomerate, the holes may become occluded by agglomerated assemblies of particles whose diameters are greater than the hole diameters. Although some smaller particles may be released, the amount can be very small, and thus the process of dispensing may take considerably longer as a consequence and in some circumstances render the process of dispensing by the dispense head unachievable.

Attempts to remedy this by employing a dispense head which has larger holes are only of limited success, because the agglomerates are not of consistent size. The result of this is that the amount of drug released from the dispense head for any given tap or mechanical action becomes very variable. If the agglomerates become larger, then the flow is restricted again. If the agglomerates are locally smaller, then too large amounts of powder can be released, leading to potential over dispensing above the target value, and the process is more difficult to control.

GB-A-2185242 discloses a feeder of loose materials for industrial use in transporting and storing various fine grain, powder pulverulent and fibrous loose materials. The feeder includes a hopper having at its base a chamber provided with a control means having the form of a latticed portion with magnetic bodies, such as spheres, placed thereon, and a source of alternating magnetic field which acts to cover the chamber by magnetic lines of force generated thereby. The latticed portion comprises a plurality of parallel vertical plates, horizontal lugs of which are received in recesses. The plates are capable of oscillating and possibly moving up and down in the recesses when the recesses are slots. When the source of magnetic field is switched off, the magnetic bodies are clustered to cover the lattice portion to prevent inadvertent escape of the loose material from the hopper of the feeder.

When the source of magnetic field is switched on, the cluster is broken up to permit the material to escape, and the magnetic bodies move randomly to impact the plates, causing them to oscillate, thereby promoting passage of material through the latticed portion. The disclosed feeder is not concerned with the dispensing of small quantities of particles, or with the problem of deagglomeration of powder particles.

The present invention at least partially aims to overcome these problems of the known apparatus and method for dispensing small quantities of particles using a dispense head.

Accordingly, the present invention provides an apparatus for dispensing small quantities of particles, the apparatus comprising a hopper provided with a sieve at a bottom portion thereof, the hopper defining a powder-containing zone above the sieve which in use contains powder to be dispensed therefrom through the sieve, a support for the hopper, the support holding a portion of the hopper so that the hopper can in use be held above a container into which the dispensed powder is to be received, at least one actuator for delivering impact energy to the hopper for causing powder to be dispensed through the sieve when the hopper receives the impact energy, and a deagglomeration device disposed in the powder-containing zone.

In some preferred embodiments, the deagglomeration device comprises at least one stirring device which Is adapted to be movable when impact energy from the at least one actuator is delivered to the hopper.

In another preferred embodiment, the deagglomeration device comprises at least one movable sealing element, the or each of which covers a respective hole in the sieve and Is movable by the impact energy from the actuator so as periodically to move temporarily away from the hole to unseal the hole and be urged against the powder thereby to cause deagglomeration thereof.

In another preferred embodiment, the deagglomeration device comprises a powder feed tube extending downwardly into the powder-containing zone for feeding powder disposed, in use, therein to a location just above the sieve.

The present invention also provides a method of dispensing small quantities of particles, the method comprising the steps of: disposing in a hopper provided with a sieve at a bottom portion thereof a powder to be dispensed therefrom through the sieve; deagglomerating the powder in the hopper by mechanically engaging the powder with a deagglomeration device disposed in a powder-containing zone located above the sieve; supporting the hopper by holding a portion of the hopper with a support so that the hopper is held above a container into which the dispensed powder is to be received; and delivering impact energy to the hopper by at least one actuator thereby to cause powder to be dispensed through the sieve when the hopper receives the impact energy.

In some preferred embodiments, the deagglomeration device comprises at least one stirring device which is adapted to be movable when impact energy from the at least one actuator is delivered to the hopper, and in the delivering step the impact energy also causes movement of the at least one stirring device in the powder.

In another preferred embodiment, the deagglomeration device comprises at least one movable sealing element the or each of which covers a respective hole in the sieve and is movable by the impact energy from the actuator so as periodically to move temporarily away from the hole to unseal the hole and be urged against the powder thereby to cause deagglomeration thereof, nd in the delivering step the Impact energy also causes movement of the at least one sealing element.

In another preferred embodiment, the deagglomeration device comprises a powder feed tube extending downwardly into the powder-containing zone for feeding powder disposed therein to a location just above the sieve.

The present invention yet further provides a powder deagglomeration device for an apparatus for dispensing small quantities of particles, the deagglomeration device comprising an elongate bridge member having opposed ends and a central part therebetween, and a plurality of elongate stirring elements fixed to and extending orthogonally away from the centre part.

This invention accordingly provides the advantage that the powder in the hopper is subjected to a deagglomeration action which tends to form a more homogeneous distribution of particle sizes, as a result of the deagglomeration action tending to reduce particle agglomeration in the hopper by physical breaking up of any agglomerates and/or by preventing any further agglomerates from being formed. This in turn tends to permit more accurate dispensing of the target weights of the powder, with in particular less incidence of over dispensing above the target dispensed weight, and also tends to provide more even dispensing times for successive doses of the same target weight.

The present invention is predicated on the discovery by the inventors that rather than modifying the dimensions of the sieve to accommodate any agglomeration of the micronised particles, which can lead to problems of over dispensing and may not in any event adequately overcome the agglomeration problem, the agglomeration problem can be reduced or substantially eliminated by mechanically treating the powder immediately prior to dispensing while the powder is in the hopper.

Embodiments of the present invention will now be described by way of example only with reference to the accompanying drawings, in which.

Figure 6:
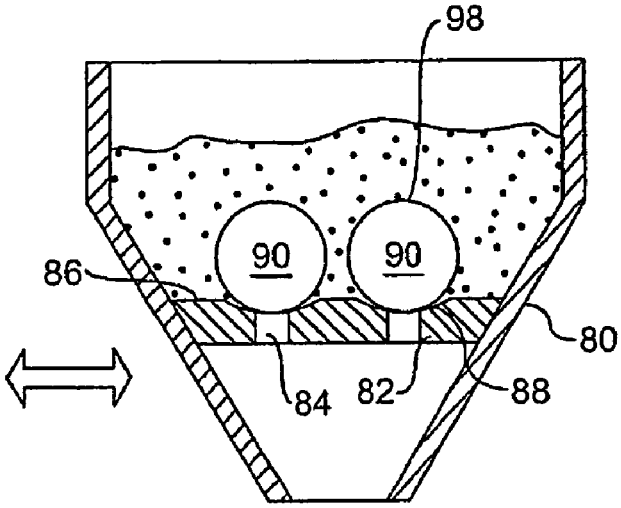
Figure 7:
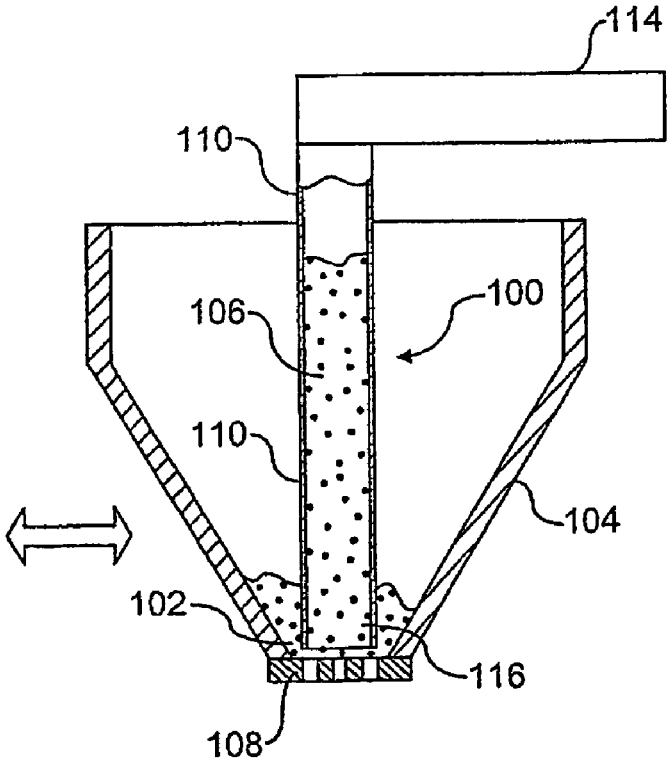

FIG. 6 is a schematic section, from one side, through a hopper, together with a deagglomeration device in the form of a plurality of balls, each of which covers a respective sieve hole, of a powder dispensing apparatus in accordance with a third embodiment of the present invention; and FIG. 7 is a schematic section, from one side, through a hopper, together with deagglomeration device in the form of a powder feed tube, of a powder dispensing apparatus in accordance with a fourth embodiment of the present invention.

Figure 1:
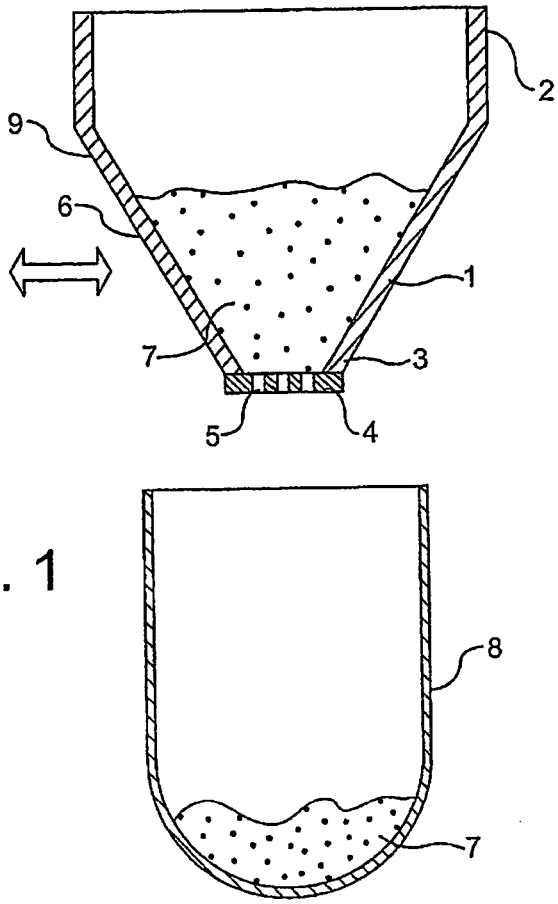
FIG. 1 is a schematic section, from one side, through a hopper of a known powder dispensing apparatus for dispensing powder into a receptacle.
Figure 2:
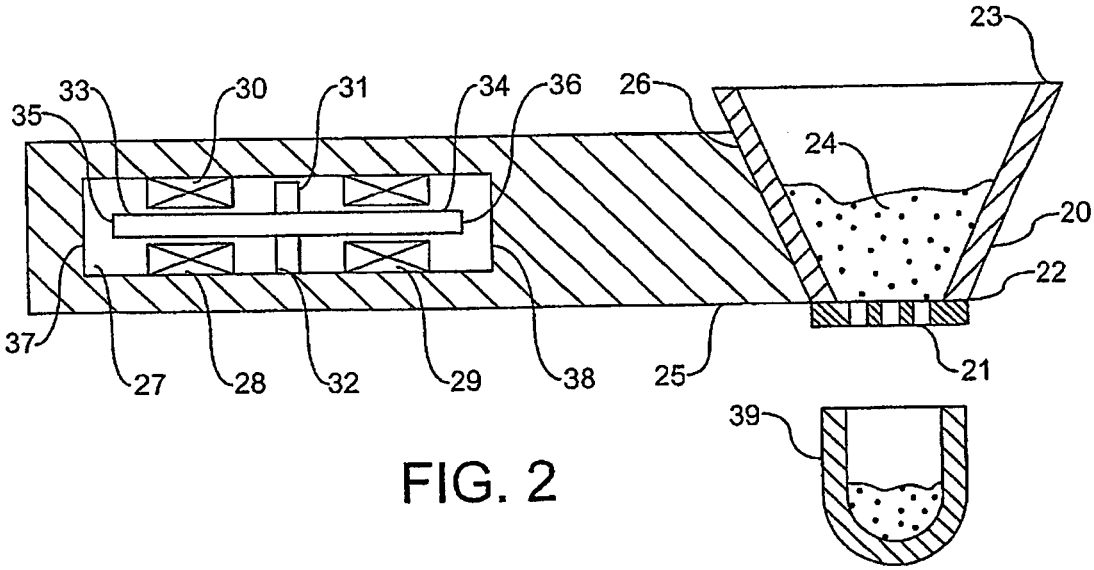
FIG. 2 is a schematic section, from one side, through a hopper, and a tapping device of a powder dispensing apparatus in accordance with a first embodiment of the present invention for dispensing powder into a receptacle.

FIG. 2 shows a hopper and a tapping device of a powder dispensing apparatus in accordance with a first embodiment of the present invention for dispensing powder into a receptacle. In this embodiment, a frusto-conical hopper 20 has a sieve 21, in the form of a horizontally oriented plate with a plurality of sieving holes therethrough, at its smaller lower end 22 and a larger upper end 23 for receiving bulk powder 24, such as medicament, to be dispensed through the sieve 21. The hopper 20 is supported by a cantilever arm 25, which is attached to or bears against a sidewall 26 of the hopper 20. Within the cantilever arm 25 is provided a longitudinally directed cavity 27, and in the cavity 27 are disposed, in a longitudinally mutually spaced configuration, a pair of longitudinally oriented first and second solenoid coils 28,29 of a solenoid 30, comprising an electromechanical actuator. The coils 28,29 are rigidly attached to the cantilever arm 25. An armature 31 of the solenoid 30 comprises a longitudinally extended body having a central bush 32 and two opposed first and second projecting portions 33,34, each of the projecting portions 33, 34 extending within a respective one of the coils 28,29, and with the bush 32 centrally disposed between the two coils 28,29. If desired, a pair of opposed helical compression springs (not shown) may be provided, with each spring located between the bush 32 and a respective coil 28,29, thereby to urge the armature 31 into a central position in the absence of any actuating force on the armature 31. The first and second projecting portions 33,34 have respective first and second end walls 35,36 which are each spaced from a respective first and second end face 37,38 of the cavity 27 when the armature 31 is in the central position.

When a first current pulse is passed through the first coil 28, the armature 31 is accelerated towards the second end face 38 of the cavity 27 and the end wall 36 impacts it. The impact momentum is transferred by the cantilever arm 25 to the hopper 20 and the bulk powder 24 therein and causes a discrete amount of the powder 24 to fall into a receptacle 39 located, in use, beneath the sieve 21 of the hopper 20. Thereafter, when a second current pulse is passed through the second coil 28, the armature 31 is accelerated towards the first end face 37 of the cavity 27 and the end wall 35 impacts it. The impact momentum is again transferred by the cantilever arm 25 to the hopper 20 and the bulk powder 24 therein and causes a discrete amount of the powder 24 to fall into the receptacle 39. Accordingly, alternate energising of the two coils 28,29 causes the armature 31 to move in opposite directions in an alternating manner.

With this arrangement it is possible to tap the hopper 20 in either direction along the cantilever arm 25. The arrow indicates the direction of tapping. Accordingly, powder dispensing may occur either by alternating the direction of tapping in successive tapping steps corresponding to successive powder dispense actions or alternatively by always using a pair of taps closely separated in time in a single tapping step to achieve a single powder dispense action.

The use of a solenoid 30 to generate the impact on the hopper 20 and the bulk powder 24 therein allows the magnitude of the impact to be altered by controlling the voltage driving the first and second coils 28,29 of the solenoid 30. Thus even if the mechanical arrangement causes some difference between the magnitude or effect of the forward and reverse taps associated with the energization of the two coils 28,29, the overall cumulative effect can be balanced by using different forward and reverse drive voltages. The same effect can be achieved by changing the pulse width, i.e. the period of time during which each coil 28,29 is switched on.

The problem of agglomeration of the bulk powder 24 in the hopper 20 above the sieve 21 is overcome in accordance with the invention by the provision of at least one stirring device in the hopper 20 which is designed either to prevent the formation of agglomerates and/or to break up any agglomerates which have formed. A number of different embodiments of the stirring device are described below.

Figure 3:
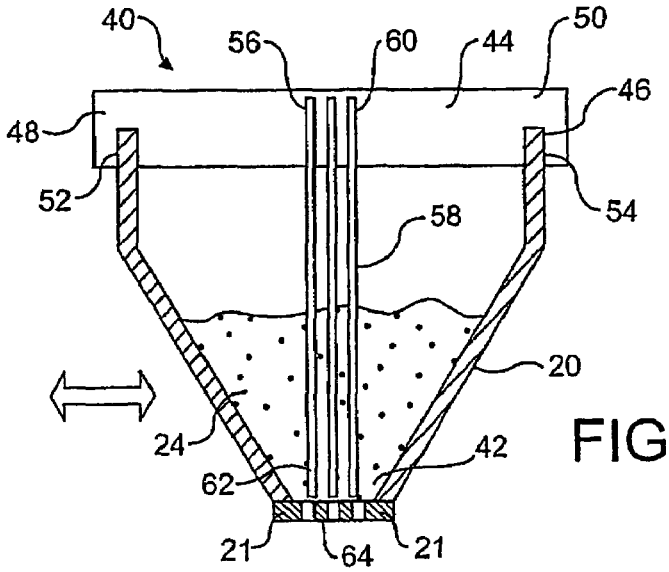
FIG. 3 is a schematic section, from one side, of the hopper of FIG. 2.

Referring to FIG. 3, there is shown a first embodiment of a stirring device, designated generally as 40, mounted above the hopper 20 so as to extend, in use, into a powder-containing zone 42, located above the sieve 21, the zone 42 in use containing the bulk powder 24 in the hopper 20 which is supported above the sieve 21. The stirring device 40 comprises a bridge piece 44 which is located on the upper peripheral rim 46 of the hopper 20. The bridge piece 44 comprises an elongate strip, for example of metal, typically stainless steel, which extends along a diameter of the hopper 20 and is fixedly attached to, or removably mounted on, the upper peripheral rim 46 of the hopper 20. In the embodiment of FIG. 3, the bridge piece 44 is removably located on the upper peripheral rim 46 and the opposed ends 48,50 of the bridge piece 44 are each provided with a respective downwardly-opening slot 52,54 into which the upper peripheral rim 46 is received so that the bridge piece 44 rests on the rim 46 under the action of gravity.

At a centre part 56 of the bridge piece 44 a plurality of downwardly depending stirring elements 58 is provided. In this embodiment, the stirring elements 58 comprise wires which are fixed at their upper ends 60 to the centre part 56 of the bridge piece 44, with the wires 58 being straight and extending vertically downwardly so that their lower ends 62 are located just above the sieve 21 in the powder-containing zone 42. In the illustrated embodiment, three wires 58 are provided, but this number may be varied. Furthermore, in the illustrated embodiment each wire 58 is straight and has a cylindrical cross-section with a smooth outer surface, but the surface may alternatively be profiled and the wires 58 may alternatively be shaped by bending along their length. The wires 58 are typically composed of stainless steel and are fixed to the bridge piece 44, for example by welding.

The wires 58 are selected to have a length and cross-section, and the material of the wires 58 is selected to have a modulus of elasticity, so that when the hopper 20 is tapped laterally, in the direction shown in FIG. 3, the impact energy on the hopper 20 is transmitted to the bridge piece 44 and thence to the wires 58 which are thereby caused to vibrate laterally. This causes the lower ends 62 of the wires 58 which are located in the power-containing zone 42 to break up any agglomerates which may be present in the vicinity of the sieve 21.

When the bridge piece 44 is removably located on the rim 46 of the hopper 20, there is preferably provided a small lateral clearance between the bridge piece 44 and the rim 46, by the provision of an appropriately wider width for each of the slots 52,54 as compared to the thickness of the rim 46, for example a difference of up to about 1 mm, to enable the bridge piece 44 to move laterally relative to the rim 46. When impact energy is delivered to the hopper 20, this causes the bridge piece 44 to move in a sliding action laterally relative to the hopper 20, which in turn permits the lower ends 62 of the wires 58 to move laterally relative to the sieve 21. This assists the effectiveness of the wires 58 breaking up any agglomerated assemblies of particles in the powder-containing zone 42 above the sieve 21. This in turn assists the delivery of regular amounts of powder through the sieve 21 for each tap.

Moreover, the weight of the combined assembly of the bridge piece 44 and the wires 58 is, in the illustrated embodiment, selected so that when the impact energy from the actuator impacts the hopper 20, the energy transmitted to the bridge piece 44 from the rim 46 can cause the bridge piece 44 to move vertically, for example up to a distance of 1 mm, in a jumping action, which in turn causes vertical movement of the lower ends 62 of the wires 58 in the bulk powder 24. This again assists in breaking up any agglomerated particles.

In the embodiment of FIG. 3, the holes 64 in the sieve 21 are preferably circular and the hole size, in particular the area, needs to be selected so as to prevent the delivery of excessively large agglomerates through the sieve 21. In this context, an excessively large agglomerate would be one which, having been dispensed through the sieve 21, could cause an inaccurate weight to be dispensed. For example, if the target weight of total powder to be dispensed were 5 mg and the target accuracy was +/−5%, i.e. a tolerance of +/−0.25 mg, then the dispensing of an agglomerate weighing more than 0.25 mg could cause overdispensing of the powder. Accordingly, the hole size of the sieve holes 64 needs to be small enough to prevent this.

If the hole diameter is 'D' then the largest spherical agglomerate which could pass through it would have a diameter very close to 'D' and its weight 'W' can be calculated from the bulk density 'd' by the following well known equation:

$$W=(4/3)\times \mathrm{Pi}\times(D/2)^3 \text{ (where Pi=3.14157)}$$

Thus an agglomerate of diameter 1 mm and density 0.4 grams per cubic centimeter would have a weight of 0.21 mg. It follows, in this example, that the hole size needs to be 1 mm diameter or smaller in order to prevent overdispensing as a result of too heavy agglomerates being able to pass through the holes.

It follows therefore that the sieve and stirring device design illustrated in FIG. 3 would need to be effective in breaking down larger agglomerates to a size smaller than the hole size (i.e. 1 mm or less in this example) so that the particles (or smaller agglomerates formed from broken up larger agglomerates previously present) may pass through the holes in the sieve, yet are not too heavy to cause overdispensing. To achieve this, the distance between the ends of the wires and the screen should be less than the hole width or diameter (1 mm in this example), the separation between the wires should be less than the hole width or diameter (1 mm in this example), and the separation between the walls of the hopper and the wires should also be less than the hole width or diameter (1 mm in this example). In this way any agglomerate reaching the sieve at the base of the hopper would be less than the hole width or diameter (in this example 1 mm). Preferably, the agglomerates should be broken down to significantly less than this dimension. However, it would be apparent to those skilled in the art that the smaller the clearance which is provided, the more difficult, and therefore costly, are the components to manufacture.

Figure 4:
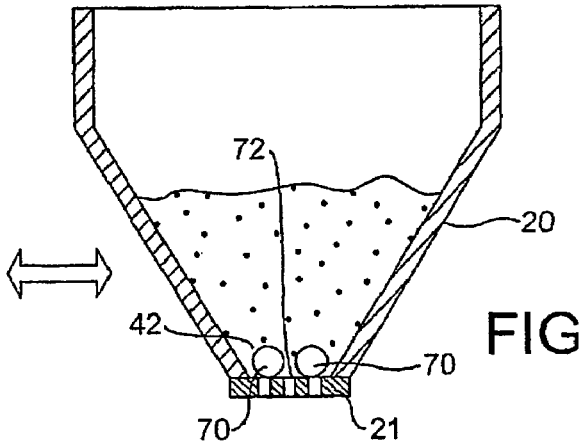
FIG. 4 is a schematic section, from one side, through a hopper, together with a deagglomeration device in the form of a plurality of stirring devices comprising movable balls, of a powder dispensing apparatus in accordance with a second embodiment of the present invention.

Referring to FIG. 4, there is shown a second embodiment of the present invention, in which the hopper 20 is provided with a plurality of stirring devices, each stirring device comprising a spherical metal ball 70 which rests under its own weight upon the upper surface 72 of the sieve 21 and is free to roll over the upper surface 72. In the illustrated embodiment, two stainless steel balls 70 are provided, although this number may be varied in accordance with the invention. Since the stainless steel of the balls 70 is much denser than the bulk powder, for example of a drug to be dispensed, the balls 70 rest against the upper surface 72 of the sieve 21.

When the hopper 20 is subjected to the tapping action as shown by the arrow in FIG. 4, the tapping action causes the balls 70 to move laterally by a rolling action, in turn causing the balls 70 to rub against each other and against any agglomerates which may be present. This causes the agglomerates to be broken up by movement of the balls 70. The number and size of the balls 70 are selected so that any interstices between the balls 70 are too small to allow passage of overlarge agglomerated particles therethrough. The number of balls 70 is preferably selected so that there Is a substantially "close packing" arrangement of the balls 70 in the powder-containing zone 42 above the sieve 21. This reduces the possibility of any particular portion of the powder-containing zone 42 above the sieve 21 not being subjected, as a result of the tapping action, to movement of any ball 70 therethrough, thereby causing deagglomeration in that particular portion.

Figure 5:
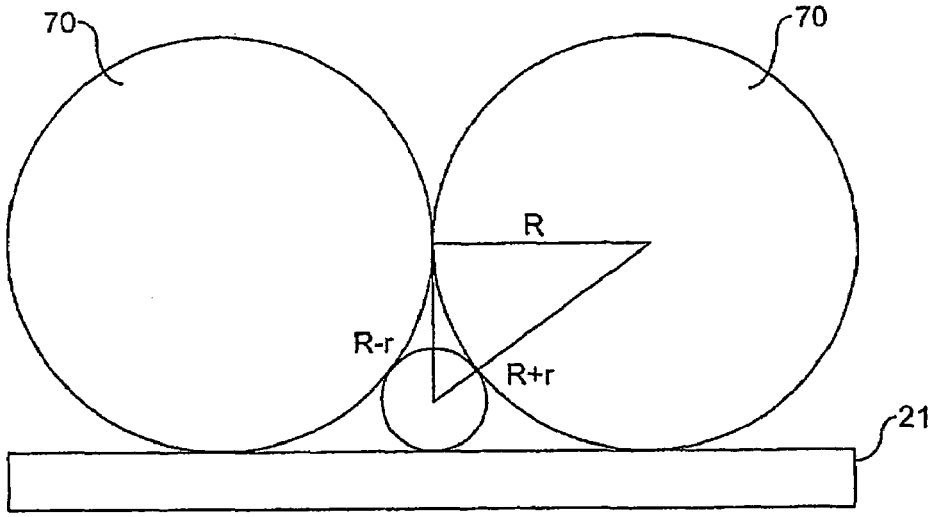
FIG. 5 is a schematic drawing showing the geometrical relationship between the balls and any agglomerates in the second embodiment of FIG. 4.

Referring to FIG. 5, this drawing shows two large balls 70 (radius R) in contact with each other and resting on the upper surface of the sieve 21. The largest agglomerate which fits beneath and between the two balls 70 is schematically shown as a small sphere (radius r). The relationship between R and r can be calculated by simple geometry as follows.

The small triangle has three side of lengths R, (R−r) and (R+r). They are related together by Pythagoras' theorem:

$$(R+r)^2=(R-r)^2+R^2$$

This equation can be rearranged to give $$4Rr=R^2$$

and hence r=R/4

Taking a specific example therefore, if the intention is to avoid agglomerates greater than 1 mm in width (since the sieve hole width or diameter is the same size, i.e. 1 mm), the ball size should be no greater than 4 mm. This calculation is of course approximate (only being a two dimensional view). However it gives a useful indication of realistic geometry requirements for, in combination, the ball size and the sieve hole size (namely the ball size should be about four times the hole size).

Referring to FIG. 6, in this embodiment, the hopper 80. is provided with a sieve 82 in the form of a plate which has been modified as compared to the sieve of the previous embodiments, in particular by the provision in the sieve 82 of a plurality of holes 84 therethrough having a cross-sectional area larger than the maximum acceptable agglomerate, and with the upper surface 86 of the sieve 82 being shaped to provide, in association with each respective individual hole 84, a downwardly directed depression 88, in each of which depressions 88 is received a respective spherical metal ball 90. Each ball 90 may be made of stainless steel. The dimensions of the balls 90 and of the holes 84 are selected so that each hole 84 is sealed by a respective ball 90, with each ball 90 resting under the action of gravity over, and thereby covering, the upper opening 96 of each hole 84. Each depression 88 preferably comprises a part-spherical concave depression 88 in the upper surface 86 of the sieve 82, with the diameter thereof being greater than that of the respective ball 90. In this way, the balls 90 are retained under the action of gravity over each respective hole 84. The width dimension of each hole 84 is selected so as to be less than the width of the arcuate outer surface 98 of the respective ball 90 which lies in the respective depression 88 associated with the hole 90, so that the holes 84 are sealed by the spherical surface 98 of the balls 90. Accordingly, the holes 84 in the sieve 82 can be significantly larger in size than in the earlier embodiments.

Prior to dispensing, the balls 90 act to prevent any powder leaving the hopper 80, because of the sealing action of the holes 84 by the balls 90. The sealing of the holes 84 does not rely upon any powder bridging the holes 84, as in the earlier embodiments, but relies rather on the holes. 84 being sealed by the respective balls 90. When the hopper 80 is tapped in the direction of the arrow shown in FIG. 6, the impact energy tends to cause a rolling action of each of the balls 90 around the respective depression 88, thereby partially unsealing the holes 84 and permitting flow of powder therethrough. The movement of balls 90, to cause partial unsealing of the holes 84, also acts to break down any agglomerates which may have been formed in the powder.

The weight and dimensions of the balls 90, and the dimensions of the associated depressions 88 and holes 84, are selected in conjunction with the impact energy from the actuator, so that no ball 90 is inadvertently caused to be moved out of its respective depression 88, or is moved by such a large displacement so that overdispensing of powder through the holes 84 could occur.

Referring to FIG. 7, in this embodiment, rather than the bulk powder being simply received in the hopper, the dispense head is additionally provided with a powder storage device, designated generally as 100, which extends downwardly into the powder-containing zone 102 of the hopper 104 and progressively deposits the powder 106 into the powder-containing zone 102 as powder 106 is dispensed out through the sieve 108 of the hopper 104. In the illustrated embodiment, the powder storage device 100 comprises a vertical tube 110 having an upper end 112 which is fixed to a stationary support 114, remote from the hopper 104, and a lower end 116 which is disposed in the powder-containing zone 102 located above the sieve 108. Powder 106 to be dispensed through the sieve 108 is initially stored within the tube 110. The powder 106 which is stored in the tube 110 prior to being deposited in the powder-containing zone 102 is mechanically separated from the hopper 104 and so is not exposed to the mechanical effect of the tapping action on the hopper 104. Such mechanical effect of the taping action acts only on the powder 106 after the powder 106 is introduced into the powder-containing zone 102 defined by the hopper 104.

This provision of a powder storage device 100, mechanically unconnected to the hopper 104, tends to reduce the amount of agglomeration which may occur as a result of the tapping action, because a proportion of the powder 106 is not exposed to the tapping action, which would otherwise tend to assist agglomerates being formed, and instead the powder 106 is only subjected to the tapping action immediately prior to being sieved through the sieve 108.

Furthermore, the lower end 116 of the powder storage device 100, since it extends into the powder-containing zone 102, moves within the powder 106 present in the powder-containing zone 102, thereby effecting a stirring action which also assists in breaking up any agglomerates which may be present, and/or prevents the agglomeration of particles in that zone 102.

The invention claimed is:

1. An apparatus for dispensing small quantities of particles, the apparatus comprising a hopper provided with a sieve at a bottom portion thereof, the hopper defining a powder-containing zone above the sieve which in use contains powder to be dispensed therefrom through the sieve, a support for the hopper, the support holding a portion of the hopper so that the hopper can in use be held above a container into which the dispensed powder is to be received, at least one actuator for delivering impact energy to the hopper for causing an amount of the powder to be dispensed through the sieve when the hopper receives the impact energy, and a deagglomeration device disposed in the powder-containing zone, wherein the deagglomeration device comprises at least one stirring device which is adapted to be movable when the impact energy from the at least one actuator is delivered to the hopper and wherein the stirring device comprises a bridge piece which is located on an upper peripheral rim of the hopper and a plurality of downwardly depending stirring elements, each stirring element having an upper end fixed to the bridge piece and a lower end located in the powder-containing zone.

2. An apparatus according to claim 1 wherein said each stirring element comprises a wire.

3. An apparatus according to claim 2 wherein each wire is selected to have a length and cross-section, and material of said each wire is selected to have a modulus of elasticity, so that when the hopper receives the impact energy from the at least one actuator, said each wire is caused to vibrate laterally.

4. An apparatus according to claim 2 wherein a mutual separation between the wires is less than a width of a hole of the sieve.

5. An apparatus according to claim 2 wherein a separation between the lower ends of the wires and the sieve is less than a width of a hole of the sieve.

6. An apparatus according to claim 1 wherein the bridge piece is removably located on the rim of the hopper and is adapted to be movable laterally relative to the rim.

7. An apparatus according to claim 6 wherein the bridge piece is provided with a downwardly-opening slot at each respective end thereof into which slots the rim of the hopper is received, with a width of the slots being greater than that of the rim.

8. An apparatus according to claim 6 wherein a weight of the bridge piece and the stirring elements is selected so that when the impact energy from the actuator impacts the hopper, the impact energy transmitted to the bridge piece from the upper peripheral rim of the hopper causes the bridge piece to jump vertically.

9. A method of dispensing small quantities of particles, the method comprising the steps of: disposing in a hopper provided with a sieve at a bottom portion thereof a powder to be dispensed therefrom through the sieve; deagglomerating the powder in the hopper by mechanically engaging the powder with a deagglomeration device disposed in a powder-containing zone located above the sieve; supporting the hopper by holding a portion of the hopper with a support so that the hopper is held above a container into which the dispensed powder is to be received; and delivering impact energy to the hopper by at least one actuator thereby to cause an amount of the powder to be dispensed through the sieve when the hopper receives the impact energy wherein the deagglomeration device comprises at least one stirring device which is adapted to be movable when the impact energy from the at least one actuator is delivered to the hopper, and in the delivering step the impact energy also causes movement of the at least one stirring device in the powder and wherein the stirring device comprises a bridge piece which is located on an upper peripheral rim of the hopper and a plurality of downwardly depending stirring elements, each stirring element having an upper end fixed to the bridge piece and a lower end located in the powder-containing zone.

10. A method according to claim 9 wherein said each stirring element comprises a wire.

11. A method according to claim 10 wherein each wire is selected to have a length and cross-section, and material of said each wire is selected to have a modulus of elasticity, so that when the hopper receives the impact energy from the at least one actuator, said each wire is caused to vibrate laterally.

12. A method according to claim 10 wherein a mutual separation between the wires is less than a width of a hole of the sieve.

13. A method according to claim 10 wherein a separation between the lower ends of the wires and the sieve is less than a width of a hole of the sieve.

14. A method according to claim 9 wherein the bridge piece is removably located on the rim of the hopper and is adapted to be movable laterally relative to the rim.

15. A method according to claim 14 wherein the bridge piece is provided with a downwardly-opening slot at each respective end thereof into which slots the rim of the hopper is received, with a width of the slots being greater than that of the rim.

16. A method according to claim 14 wherein a weight of the bridge piece and the stirring elements is selected so that when the impact energy from the actuator impacts the hopper, the impact energy transmitted to the bridge piece from the upper peripheral rim of the hopper causes the bridge piece to jump vertically.

* * * * *

UNITED STATES PATENT AND TRADEMARK OFFICE

CERTIFICATE OF CORRECTION

PATENT NO. : 7,665,633 B2
APPLICATION NO. : 10/503370
DATED : February 23, 2010
INVENTOR(S) : MacMichael et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1355 days.

Signed and Sealed this

Seventh Day of December, 2010

David J. Kappos

David J. Kappos
*Director of the United States Patent and Trademark Office*